United States Patent [19]

Powers

[11] Patent Number: 4,758,827

[45] Date of Patent: Jul. 19, 1988

[54] DUCT SMOKE DETECTOR

[75] Inventor: Robert B. Powers, Norwell, Mass.

[73] Assignee: ADT, Inc., Parsippany, N.J.

[21] Appl. No.: 890,133

[22] Filed: Jul. 28, 1986

[51] Int. Cl.[4] ..... G08B 23/00

[52] U.S. Cl. ..... 340/693; 116/273

[58] Field of Search ..... 340/693, 610, 629, 628, 340/630, 631, 632; 98/42.03, 42.15; 406/34, 36; 73/861.77, 861.33, 861.74, 23, 26; 116/271, 273, 274, 264

[56] References Cited

U.S. PATENT DOCUMENTS

| | | | |
|---|---|---|---|
| 3,922,525 | 11/1975 | Kozak et al. | 73/861.77 |
| 4,164,866 | 8/1979 | Mitchell et al. | 73/861.77 |
| 4,172,381 | 10/1979 | Aiguer | 73/861.77 |
| 4,565,090 | 1/1986 | Gotanda | 73/861.77 |

FOREIGN PATENT DOCUMENTS

| | | | |
|---|---|---|---|
| 0130558 | 1/1985 | European Pat. Off. | 340/629 |
| 2846310 | 4/1980 | Fed. Rep. of Germany | 340/693 |

*Primary Examiner*—Glen R. Swann, III
*Assistant Examiner*—Tat K. Wong
*Attorney, Agent, or Firm*—James H. Grover; Charles B. Smith

[57] ABSTRACT

Apparatus for sensing smoke in a duct includes a housing with inlet and outlet ports and a flow chamber which directs gas flow on a path between the ports and to and from a smoke detector. A vaned rotor on the path is visible through a window in the housing gives a visual indication of the existence or nonexistence and direction of gas flow and thus whether or not normally flowing duct gas is being sensed.

6 Claims, 1 Drawing Sheet

DUCT SMOKE DETECTOR

BACKGROUND OF THE INVENTION

Detectors which sense the presence of smoke or similar dense gases are used primarily in rooms and spaces but have a special use sensing smoke in ducts and flues conducting normally relatively clear exhause gases. It being often impractical to install the detector inside the duct, it is customary to conduct the gas to and from the detector with two pipes one upstream and one down stream of the detector. A sample of the duct gas normally flows from a higher pressure point at the upstream pipe, past the smoke detector and thence out the down stream pipe. But in an abnormal flow condition, which may be hazardous, the gas flow may stop or reverse without triggering the smoke detector and thus with no way of indicating whether normal gas flow or abnormal, possibly hazardous flow exists.

Objects of the present invention are to sense and indicate the direction of gas flow from a duct to a smoke detector.

SUMMARY OF THE INVENTION

According to the invention apparatus for detecting gas and smoke flow in a duct comprises a smoke detector; a housing around the detector including inlet and outlet ports for communication with the duct and means directing gas flow on a path between the ports to and from the detector; and a vaned rotor on the path rotated by flow of gas to give a visual indication of the gas flow. Preferably the housing has a window for viewing the rotor, and means for indicating the direction of its rotation between the ports.

DRAWING

DESCRIPTION

Figure 1:
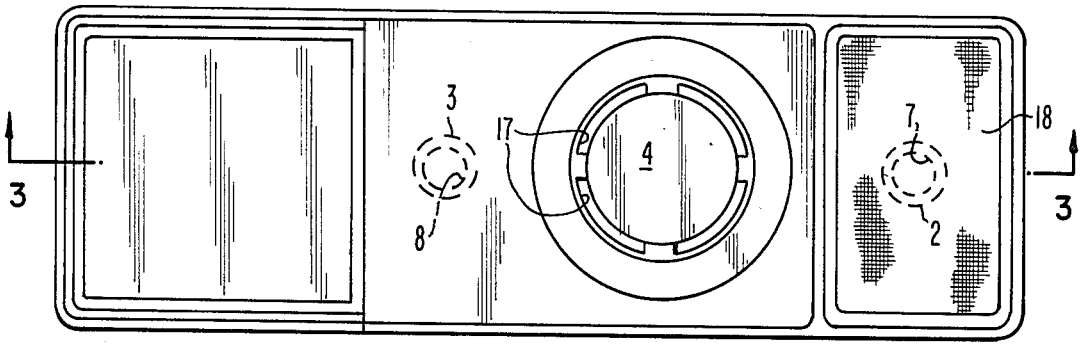
FIG. 1 shows a duct smoke detector housing.
Figure 2:
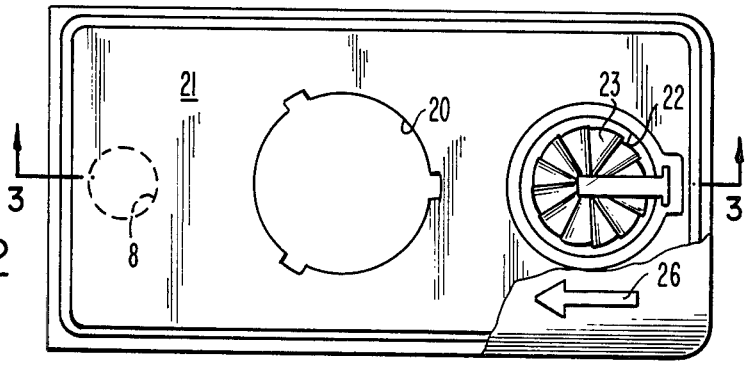
FIG. 2 is a cover for the detector.
Figure 3:
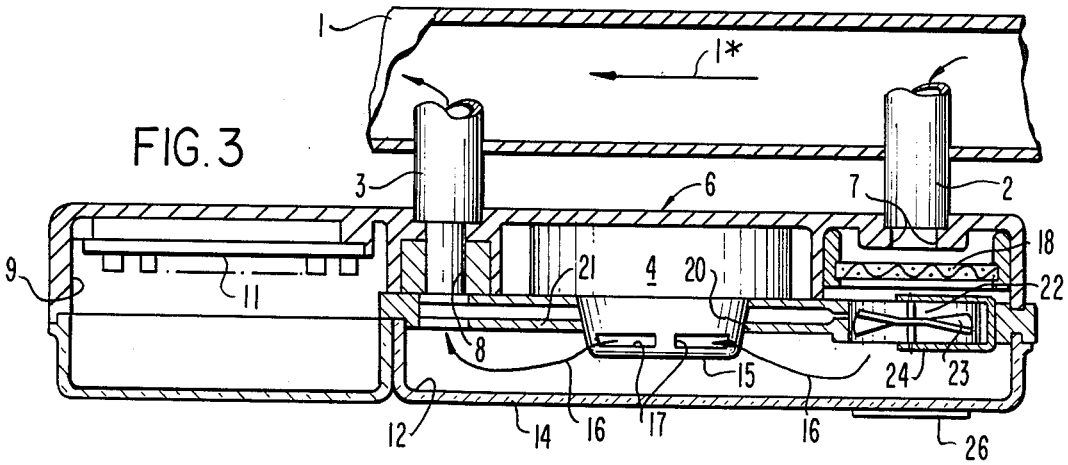
FIG. 3 is a section on lines 3—3 of FIGS. 1 and 2 showing the housing and cover assembled.

The smoke detector of FIGS. 1 to 3 is connected to a duct 1 by pipes 2 and 3. With normal gas flow in the duct as shown by the arrow 1* a sample of the gas will flow from a point of relatively high pressure into the up stream pipe 2, and return to the duct through the down stream pipe 3 at a point of relatively lower pressure even if the pressure differential is quite low. A photoelectric smoke detector 4 is mounted within a housing 6 around the detector. The housing 6 has inlet and outlet ports 7 and 8 respectively communicating with the duct 1 through the pipes 2 and 3 respectively.

The housing 6 encloses two chambers, a first chamber 9 for an electronic circuit board 11 mounting the supply and alarm relay circuits connected to the detector 4, and a second, separate flow chamber 12 formed between the housing and a cover 14 which forms a gas path 16 between the inlet and outlet ports 7 and 8. The gas path flows into and out of the detector 4 through openings 17 in a nose 15 of the detector 4 which extends through an opening 20 in an inner wall 21 of the cover so that the major bulk of the detector 4 does not obstruct gas flow through the chamber 12.

Between the inlet port 7 and the gas flow chamber 12 is a coarse filter 18 for particles larger than usual smoke particles. Inward of the filter is a widened inlet extension 22 of the inlet port 7 formed in the housing cover 14. A lightweight vaned rotor or fan 23 is mounted in jewel bearings on a bracket 24 so as to be spun by gas current through the inlet port.

Normally the gas current diverted from the duct past the detector will be of very low velocity and the vaned rotor will spin so slowly that its direction of rotation can be discerned. For this purpose the cover 14 over the rotor is of transparent plastic material providing a window into the housing to view the rotor. On the window of the housing cover is an index arrow 26 which is at one side of the rotor, and indicates the normal direction of the vanes of the rotor at that side with normal flow of gas through the inlet and outlet ports as shown by the arrows 16. With zero velocity flow of gas, the vane standing still, or with reverse flow and rotation a hazardous condition in the duct or its source of gas will indicate that safety procedures should be started.

It should be understood that the present disclosure is for the purpose of illustration only and that this invention includes all modifications and equivalents which fall within the scope of the appended claims.

I claim:

1. Apparatus for detecting gas and smoke flow in a duct comprising:

a smoke detector:

a housing around the detector including inlet and outlet ports for communication with the duct and means directing gas flow on a path between the ports to and from the detector;

a vaned rotor on the path rotated by flow of gas to give a visual indication of the gas flow; and a window into the housing for viewing the rotor.

2. Apparatus according to claim 1 including means on the housing indicating the direction of rotation by normal gas flow between the inlet port and the outlet port.

3. Apparatus according to claim 1 including a cover over the gas flow path.

4. Apparatus according to claim 3 wherein the cover is transparent over the rotor.

5. Apparatus according to claim 3 including an electronic circuit connected to the detector and located outside the cover.

6. Apparatus according to claim 1 wherein the smoke detector has a nose with openings into the detector and the cover includes an inner wall at one side of the gas flow path, admitting the nose and openings into the path.

* * * * *